United States Patent [19]

Bilimoria et al.

[11] Patent Number: 4,518,491

[45] Date of Patent: May 21, 1985

[54] BENEFICIATION OF CLAYS BY FROTH FLOTATION

[75] Inventors: Bomi M. Bilimoria, Tennille; Anthony A. May, Sandersville, both of Ga.

[73] Assignee: Anglo-American Clays Corporation, Sandersville, Ga.

[21] Appl. No.: 417,663

[22] Filed: Sep. 13, 1982

[51] Int. Cl.[3] ..... B03D 1/14

[52] U.S. Cl. ..... 209/166; 75/1 T; 252/61

[58] Field of Search ..... 209/3, 4, 5, 8, 9, 10, 209/166, 167; 75/1 T; 252/61

[56] References Cited

U.S. PATENT DOCUMENTS

| | | | |
|---|---|---|---|
| 3,737,333 | 6/1973 | Sawyer | 209/5 |
| 3,804,243 | 4/1974 | Yang | 209/166 |
| 3,979,282 | 9/1976 | Cundy | 209/166 |
| 4,098,688 | 7/1978 | Nott | 209/166 |
| 4,339,042 | 7/1982 | Windle et al. | 252/61 |

*Primary Examiner*—Bernard Nozick

*Attorney, Agent, or Firm*—Stefan J. Klauber

[57] ABSTRACT

Aliphatic complex phosphate esters or salts thereof, of a non-ionic surface active compound, are utilized together with aliphatic fatty acids as collector agents during flotation for removing titanium-based impurities from kaolin clays in a froth flotation process.

12 Claims, No Drawings

BENEFICIATION OF CLAYS BY FROTH FLOTATION

This invention describes methods for the beneficiation of kaolin and other clay minerals whereby titaniferrous discolorants are selectively removed during froth flotation, whereby the brightness of the clay minerals is improved.

Clay minerals occurring in nature, including kaolin clays, frequently contain discoloring contaminants in the form of iron and/or titanium-based impurities. The quantities of these titaniferrous impurities in sedimentary kaolins of Georgia are significant and are commonly present as iron oxide-stained titanium oxides. In order to refine these clays and bring the brightness characteristics of the resultant product to a level acceptable for various applications such as paper coating, several techniques have been used in the past to remove the discoloring impurities. Thus, for example, hydrosulfites have been widely used for converting at least part of the iron-based impurities to soluble form, which may then be extracted from the clay.

One of the most effective methods for removing titaniferrous impurities, including iron oxide-stained titanium oxides, is the froth flotation technique. Generally, according to this method, an aqueous suspension or slurry of the clay is formed, the pH of the slurry is raised to an alkaline value, and a collector agent is added. The slurry is then conditioned by agitating for a short period. A frothing agent, if necessary, is added to the conditioned slurry after which air is passed through the slurry in a froth flotation cell, to effect separation of the impurities from the mineral. The impurities or the mineral may be removed as the froth.

Further details regarding the use of froth flotation techniques for removing titanium-based impurities from kaolins, may be found at numerous points in the prior art, including, for example, in U.S. Pat. No. 3,450,257 to E. K. Cundy. The Cundy disclosure will be found illustrative further of the fact that the prior art has almost universally regarded aliphatic fatty acids only, most notably oleic acid, as the collector agent appropriate and effective for use where titanium-based impurities are to be removed.

In recent years, it has been reported that certain classes of phosphate esters can serve as collector agents in mineral beneficiation processes. U.S. Pat. No. 3,480,143 to Mitzmager et al, teaches that certain acid esters of phosphorous acids are useful in flotation separation of a siliceous ore into a floated heavy mineral fraction, and a non-floated siliceous fraction. U.S. Pat. No. 3,804,243 and 3,837,488 to Yang disclose the use of complex phosphate esters of the type considered in the present invention, as being successful in froth flotation processes for separating mica and kaolin clays in a crude containing both components.

Further, U.S. Pat. No. 4,090,688 to Alan Nott discloses the use of complex phosphate esters as collector agents for removing titanium-based impurities from kaolin clays in froth flotation process.

The present invention is distinguished from the Nott teaching in several important respects. Thus, while Nott uses only the complex phosphate esters as a collector agent during flotation, the present invention uses a combination of fatty acid and complex phosphate ester as collector agents during flotation. Our use of this specific combination of collector agents during flotation gives a product that has a brightness that is markedly superior to the brightness obtained by using only oleic acid or only the complex phosphate ester as a collector agent during flotation. Thus, a synergistic effect is achieved during flotation carried out in accordance with the present invention.

The present invention is further distinguished from the Nott patent, by the type of complex phosphate esters used as collector agents. The Examples given in the Nott patent use complex phosphate esters with an aromatic hydrocarbon group attached to one end of the alkylene oxide chain, while in the present invention only complex phosphate esters with an aliphatic hydrocarbon group attached to one end of the alkylene oxide chain have been found to be successful. Work carried out in the laboratory indeed showed that the use of complex phosphate esters with an aromatic group attached to the alkylene oxide chain, when used in combination with oleic acid, did not give a product which was brighter than that produced by using oleic acid alone as the collector agent during flotation.

SUMMARY OF INVENTION

Thus, in accordance with the present invention, it has unexpectedly been found that aliphatic complex phosphate esters or salts thereof of a non-ionic surface active compound can be used along with an aliphatic fatty acid as collector agents in froth flotation processes for removing titanium-based impurities from kaolin clays with significant amounts of these contaminants.

In a typical procedure in accordance with the invention, an aqueous dispersion of the clay is formed. The dispersion is blunged and conditioned in the presence of an aliphatic complex phosphate ester and an aliphatic fatty acid, after which the blunged and conditioned slurry is subjected to a froth flotation treatment to effect separation of the contaminants with the froth. In a preferable procedure, the solids content of the slurry during blunging and conditioning is in the range of 25 to 65%, and the pH of the slurry is brought to the range of 7 to 10. At least 10 hp-hr of energy is dissipated per ton of solids during the blunging and conditioning step, and preferably over 25 hp-hr per ton of solids is thus dissipated. A preferred range of addition for the aliphatic complex phosphate ester collector agent is 0.1 to 2.5 lbs/ton of solids in the slurry, with 0.25 to 0.75 lbs/ton of solids being still more preferred. A preferred range of addition for the aliphatic fatty acid collector agent is 1 to 10 lbs/ton of solids in the slurry, with 2 to 5 lbs/ton of solids being still more preferred.

Although the precise reasons for the remarkable improvement in the brightness of the clay floated with the above-mentioned combination of collectors is not fully understood, the brightness of the clay processed using the technique described in this invention improved from 0.3 to about 2 units on the G.E. brightness scale compared to clay processed using only an aliphatic fatty acid. Flotation of impurities from clay could not be effectively carried out when the aliphatic complex phosphate ester was exclusively used as the collector agent.

DESCRIPTION OF PREFERRED EMBODIMENTS

The aliphatic complex phosphate esters that can be used in the present invention are those described in detail in U.S. Pat. No. 3,567,636 to Katzenstein. This patent discloses the mode of preparation and composition of the above-mentioned phosphate esters, and the disclosure thereof is incorporated herein by reference. As indicated in the cited patent, the aliphatic complex phosphate esters or salts thereof are non-ionic surface active compounds and may be selected from the group consisting of monoesters, di-esters, and mixtures thereof. The non-ionic surface active compound is the condensation product of an organic hydroxy compound of from 8 to 50 carbon atoms, selected from the group consisting of alkyl alcohols with at least one mole of an alkylene oxide having from 2 to 3 carbon atoms, the non-ionic surface active compound containing a maximum of about 50% by weight of alkylene oxide, based on the weight of the non-ionic surface active compound. Many of these phosphate esters are commercially available from the GAF Corp., New York, under the trade name "GAFAC." The commercial products are usually mixtures of mono- and di-esters. A typical such product useful in the invention is commercially available under the designation of "GAFAC RS-610." This composition is believed to be a mixture of mono-ester and di-ester, principally di-ester, wherein the mono-ester constituent has the structural formula:

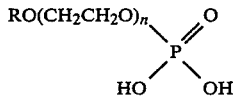

(1)

wherein R=alkyl group and n=5 to 7; and wherein the di-ester constituent has the structural formula:

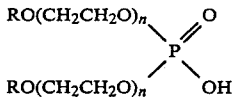

(2)

wherein R=alkyl group and n=5 to 7. The said acid ester can be used is salt form, e.g. as the sodium, ammonium, calcium, or magnesium salt. In use, the acid is converted to alkali metal salt form in the basic clay slurry.

A series of tests were run to demonstrate the efficacy of the present invention wherein discolored kaolin clays were subjected to froth flotation treatment as disclosed herein, with the result of such treatment being compared with froth flotation effected with the most common collector agent of the prior art, i.e. oleic acid. Clays used in these tests were sedimentary soft Georgia kaolins, typically having a $TiO_2$ content of 1.5 to 2.0%.

In a typical procedure, the crude clay was blunged and conditioned by forming an aqueous alkaline dispersion of the clay, the pH being adjusted in the range of 7 to 10 with ammonium hydroxide or sodium hydroxide. The dispersion was carried out by the addition of sodium silicate in the range of 0.5 to 10 lbs/ton of solids. If dispersion was very difficult, a polyacrylate was added to the slurry in the range of 0.1 to 5 lbs/ton of solids. The collector agent, e.g. oleic acid for control tests, and a combination of the aliphatic complex phosphates ester and oleic acid for the disclosure tests is added to the clay slurry and conditioned for 15 minutes. For some tests, an aluminum salt was also added to the slurry along with the phosphate and fatty acid collector agent.

The slurry during blunging and conditioning operations may include from about 25 to 65% solids. The conditioning process is preferably continued for sufficient time to dissipate at least 25 hp-hr of energy per ton of solids, although generally the invention is effective even where as little as 10 hp-hr per ton of solids is dissipated. The blunged and conditioned slurry is then subjected to a conventional treatment in a froth flotation cell.

After flotation of the impurities was completed, the slurry was screened on a 325 mesh screen to remove sand. The slurry was then passed through a magnetic separator of the type disclosed in Marston, U.S. Pat. No. 3,627,678 using an average field intensity during treatment of about 6 kilogauss, and a retention time in the field of about 67 seconds. The output from the separator was then bleached with 8 lbs/ton solids of sodium hydrosulfite. The slurry was then batch centrifuged to obtain 90 to 94% less than 2 micron size in the product after which it was filtered, dried, and pulverized. The brightness values stated in all the Examples are G.E. brightness values of the pulverized product which have been obtained according to the standard specification established by TAPPI procedure T 646 os-75.

EXAMPLE I

The kaolin clay was processed as stated above. Flotation was carried out using concentrations of the various chemicals set forth in Table I. To compare performance, a combination of the aliphatic complex phosphate ester with oleic acid was used as the collector agent and its performance measured against the prior art technique of using only oleic acid as the collector agent. The results are set forth in Table I.

TABLE I

| | Oleic flotation | Oleic + phosphate ester flotation |
|---|---|---|
| Polyacrylate | 0.5 lbs/ton | 0.5 lbs/ton |
| Sodium silicate | 1 lb/ton | 1 lb/ton |
| Sodium hydroxide | 3.3 lbs/ton | 3.3 lbs/ton |
| Oleic acid | 7.3 lbs/ton | 7.3 lbs/ton |
| GAFAC RO-310* | — | 1 lb/ton |
| pH | 9.5 | 9.5 |
| Solids, % | 60 | 60 |
| Conditioning Time | 15 minutes | 15 minutes |
| Product Brightness | 90.2 | 91.0 |
| % $TiO_2$ in Product | 0.43 | 0.17 |

*In accordance with formulae (1) and (2) above.

As can be ascertained from Table I, when flotation was carried out using oleic acid and the aliphatic complex phosphate ester, the product brightness was higher and the % $TiO_2$ in kaolin was lower compared to data obtained for kaolin floated with oleic acid alone.

EXAMPLE II

In the Example, a further aliphatic complex phosphate ester was used, and the experimental details and results are given in Table II.

TABLE II

| | Oleic flotation | Oleic + phosphate ester flotation |
|---|---|---|
| Polyacrylate | 0.2 lbs/ton | 0.4 lbs/ton |
| Sodium silicate | 1.8 lbs/ton | 1.8 lbs/ton |
| Sodium hydroxide | 8 lbs/ton | 8 lbs/ton |
| Oleic acid | 2.5 lbs/ton | 2.4 lbs/ton |
| GAFAC RS 610* | — | 0.5 lb/ton |
| pH | 9.5 | 9.5 |
| Solids, % | 60 | 60 |
| Conditioning Time | 15 minutes | 15 minutes |
| Product Brightness | 89.8 | 90.1 |

TABLE II-continued

| | Oleic flotation | Oleic + phosphate ester flotation |
|---|---|---|
| $TiO_2$, % | 0.63 | 0.49 |

*See Formulae (1) and (2) above.

EXAMPLE III

In the Example, all flotation conditions were the same as given in Example II, except that during the oleic+phosphate ester flotation, aluminum sulfate was added to the kaolin slurry during blunging and conditioning. These results are given in Table III.

TABLE III

| | Oleic flotation | Oleic + phosphate ester flotation |
|---|---|---|
| Polyacrylate | 0.2 lbs/ton | 0.4 lbs/ton |
| Sodium silicate | 1.8 lbs/ton | 1.8 lbs/ton |
| Ammonium hydroxide | 8 lbs/ton | 8 lbs/ton |
| Oleic acid | 2.5 lbs/ton | 2.4 lbs/ton |
| GAFAC RS-610 | — | 0.5 lb/ton |
| Aluminum sulfate | — | 0.5 lb/ton |
| pH | 9.5 | 9.5 |
| Solids, % | 60 | 60 |
| Conditioning Time | 15 minutes | 15 minutes |
| Product Brightness | 89.8 | 90.9 |
| $TiO_2$, % | 0.63 | 0.45 |

EXAMPLE IV

In this Example, a series of tests were run as described in the previous Examples, and the results are summarized in the following Table.

TABLE IV

| | Oleic Flotation | Phosphate Ester Flotation | Oleic + Phosphate Ester Flotation | Oleic + Phosphate Ester + Aluminum Sulfate Flotation |
|---|---|---|---|---|
| Sodium Silicate | 1.8 lbs/ton | 1.8 lbs/ton | 1.8 lbs/ton | 1.8 lbs/ton |
| Ammonium hydroxide | 11 lbs/ton | 11 lbs/ton | 11 lbs/ton | 11 lbs/ton |
| Oleic acid | 4 lbs/ton | — | 3.5 lbs/ton | 3.5 lbs/ton |
| GAFAC RS-610 | — | 4 lbs/ton | 0.5 lb/ton | 0.5 lb/ton |
| Aluminum Sulfate | — | — | — | 0.5 lb/ton |
| pH | 9.5 | 9.5 | 9.5 | 9.5 |
| Solids, % | 60 | 60 | 60 | 60 |
| Conditioning Time | 15 minutes | 15 minutes | 15 minutes | 15 minutes |
| Product Brightness | 90.7 | 89.6 | 91.3 | 91.4 |
| $TiO_2$, % | 0.32 | 1.06 | 0.27 | 0.21 |

These Examples clearly establish that the product brightness obtained by the use of the process of the present invention is superior to the product brightnesses obtained by the prior art techniques. This improvement in product brightness appears to be related to better removal of titaniferrous impurities in the clay during flotation by use of a complex phosphate ester together with oleic acid as collector agents.

While this invention has been particularly set forth in terms of specifics, it is understood in view of this disclosure, that numerous variations upon the invention are now enabled to those skilled in the art, which variations yet reside within the scope of the present teaching. Accordingly, the invention is to be broadly construed, and limited only by the scope and spirit of of the claims now appended hereto.

We claim:

1. A method for removing titaniferrous discoloring contaminants from a kaolin clay, to thereby increase the brightness of said clay, said method comprising:

forming an aqueous dispersion of said clay, and blunging and conditioning said dispersion in the presence of a collector agent for said titaniferrous contaminants, said agent comprising a combination of a complex mixture of a mono-phosphate ester and a diphosphate ester or salt thereof, of a non-ionic surface active compound, together with oleic acid; wherein said non-ionic surface active compound is the condensation product of an alkyl alcohol having from 8 to 50 carbon atoms with at least one mole of an alkylene oxide having from 2 to 3 carbon atoms and containing a maximum of about 50% by weight alkylene oxide based on the weight of the non-ionic surface active compound; and subjecting said blunged conditioned slurry to a froth flotation treatment to effect separation with said froth of said collected titaniferrous contaminants.

2. A method in accordance with claim 1, wherein said dispersion during said blunging and conditioning step includes 25% to 65% solids.

3. A method in accordance with claim 1, wherein at least 10 hp-hr of energy per ton of solids is dissipated during said blunging and conditioning step.

4. A method in accordance with claim 1, wherein the pH of said dispersion is in the range of from about 7 to 10.

5. A method in accordance with claim 4, wherein the aliphatic complex phosphate ester is added in concentrations from 0.1 to 2.5 pounds/ton of solids and oleic acid is added in concentrations from 1 to 10 pounds/ton of solids in said slurry.

6. A method in accordance with claim 5, wherein said ester is added in concentration of from 0.25 to 0.75 pounds/ton of solid; and said oleic acid is added in concentrations of from 2 to 5 pounds/ton of solid.

7. A method in accordance with claim 1, wherein aluminum ions are added to the dispersion in the form of soluble salts in a concentration range of 0.05 to 1 pound/ton of solids in the slurry.

8. A method in accordance with claim 7, wherein said dispersion during said blunging and conditioning step includes 25% to 65% solids.

9. A method in accordance with claim 7, wherein the pH of said dispersion is in the range of from about 7 to 10.

10. A method in accordance with claim 7, wherein at least 10 hp-hr of energy per ton of solids is dissipated during said blunging and conditioning step.

11. A method in accordance with claim 10, wherein the aliphatic complex phosphate ester is added in concentrations from 0.1 to 2.5 pounds/ton of solids and oleic acid is added in concentrations from 1 to 10 pounds/ton of solids in said slurry.

12. A method in accordance with claim 10, wherein said ester is added in concentrations of from 0.25 to 0.75 pounds/ton of solid; and said oleic acid is added in concentrations of from 2 to 5 pounds/ton of solid.

* * * * *